US005520027A

United States Patent [19]

McCartney et al.

[11] Patent Number: 5,520,027

[45] Date of Patent: May 28, 1996

[54] APPARATUS FOR WET PROCESSING OF TEXTILE FABRIC

[75] Inventors: Phillip D. McCartney; Arne Nielsen, both of Oak Ridge; Majid Moghaddassi, Greensboro, all of N.C.

[73] Assignee: Guilford Mills, Inc., Greensboro, N.C.

[21] Appl. No.: 170,614

[22] Filed: Dec. 20, 1993

[51] Int. Cl.[6] ..... D06B 3/28

[52] U.S. Cl. ..... 68/13 R; 68/27; 68/62; 68/177

[58] Field of Search ..... 68/13 R, 62, 176, 68/177, 178, 27

[56] References Cited

U.S. PATENT DOCUMENTS

| | | | |
|---|---|---|---|
| 2,753,706 | 7/1956 | Franklin | 68/177 X |
| 3,698,212 | 10/1972 | Ameling et al. | 68/178 |
| 3,700,404 | 10/1972 | Janisch et al. | 68/177 X |
| 3,771,337 | 11/1973 | Trullas | 68/178 |
| 4,015,452 | 4/1977 | Kreitz | 68/177 X |
| 4,020,658 | 5/1977 | Thies, Jr. | 68/177 X |
| 4,107,801 | 8/1978 | Tachibana | 68/176 X |
| 4,142,385 | 3/1979 | Sandberg et al. | 68/178 |
| 4,182,141 | 1/1980 | Sando et al. | 68/177 X |
| 4,440,003 | 4/1984 | Koch | 68/177 X |
| 5,077,851 | 1/1992 | Guma | 68/178 X |
| 5,235,828 | 8/1993 | Aurich et al. | 68/177 X |
| 5,311,627 | 5/1994 | Koch et al. | 68/178 X |

FOREIGN PATENT DOCUMENTS

| | | | |
|---|---|---|---|
| 2448385 | 4/1976 | Germany | 68/27 |
| 37234 | 9/1972 | Japan | 68/177 |

*Primary Examiner*—Philip R. Coe

*Attorney, Agent, or Firm*—Shefte, Pinckney & Sawyer

[57] ABSTRACT

An apparatus for wet processing of textile fabric in endless rope form is disclosed which basically comprises a processing vessel, dual oppositely-extending fabric travel paths within the vessel for lengthwise movement of the fabric in successive alternation through the two travel paths, and dual lifter reels and jet nozzles between the adjacent entrance and exit ends of the respective travel paths, providing more positive continuous fabric traveling movement, increased fabric processing capacity, and reduced fabric processing time in comparison to conventional wet processing operations utilizing a single lifter reel, jet nozzle, and fabric travel path.

21 Claims, 8 Drawing Sheets

APPARATUS FOR WET PROCESSING OF TEXTILE FABRIC

BACKGROUND OF THE INVENTION

The present invention relates generally to apparatus for wet processing of textile fabric in endless rope form and, more particularly, to such wet processing apparatus wherein the fabric is circulated through a processing vessel by entrainment of the fabric in a jetted portion of the treating liquid.

Various forms of jet-type wet processing machines exist for dyeing and other liquid treatment of textile fabrics. These machines characteristically provide a vessel in which an extended length of the fabric is circulated in endless rope form, i.e., with the opposite ends of the fabric temporarily sewn together, to carry out a liquid treatment operation. More specifically, the vessel contains a bath of the treating liquid in which the predominant length of the fabric resides in plated form at any given time during the treatment operation, circulation of the fabric being accomplished by continuously withdrawing the fabric from the bath at one end or side of the vessel by a driven lifter reel and then returning the withdrawn fabric-into the bath at the other side or end of the vessel by means of a venturi tube or similar jet or nozzle structure through which a portion of the liquid bath is continuously pumped to entrain and direct the fabric back into the bath. The major portion of the fabric within the bath progresses slowly through the bath under the combined action of the lifter reel and the jet, together with the natural tendency of the fabric to float in the bath.

While jet-type fabric processing machines of the above-described type function satisfactorily for their intended purposes, efforts are ongoing within the textile industry to develop improved wet processing apparatus which will minimize the volume of the liquid bath required for a given processing operation, thereby to reduce the costs of processing chemicals as well as the costs and environmental hazards attendant to disposing of and/or cleaning waste processing liquid remaining at the completion of a processing operation. Similarly, the need and desire continues within the industry to develop wet processing machinery of increased capacity and production rates over conventional equipment without increasing at the same time the bulk and floor space required for the machinery.

SUMMARY OF THE INVENTION

It is accordingly an object of the present invention to provide an improved jet-type apparatus for wet processing of textile fabric which will satisfy the above-described needs of the relevant industry.

Briefly summarized, the apparatus of the present invention basically comprises a processing vessel for containing a textile fabric in endless rope form and a treating liquid. A suitable structure is provided within the vessel for defining first and second fabric travel paths each having an entrance end and an exit end, the travel paths extending in opposition to one another with the entrance and exit ends of each path generally adjacent the exit and entrance ends, respectively, of the other path to facilitate lengthwise movement of the fabric in successive alternation through the first and second travel paths. An arrangement is disposed intermediate the adjacent entrance and exit ends of the travel paths for transferring the fabric between, and continuously circulating the fabric through, the first and second travel paths, including first and second liquid nozzles at the respective entrance ends of the first and second travel paths for entrainment of the fabric by a moving portion of the treating liquid.

According to one aspect of the present invention, the fabric transferring and circulating arrangement includes a means for substantially synchronizing traveling movement of the fabric through the first and second travel paths, preferably by determining the instantaneously length of the fabric residing within each travel path at any selected time during a wet processing operation, e.g., by providing first and second fabric seam detectors respectively intermediate the adjacent entrance and exit ends of the travel paths.

The fabric transferring and circulating means may also include first and second lifter reels at the respective exit ends of the travel paths for progressively withdrawing the fabric therefrom and delivering the withdrawn fabric at each location to the respective nozzle at the adjacent entrance end of the other travel path. To detect slippage of the fabric on the lifter reels, a detector is provided for monitoring the traveling speed of the fabric in advance of each lifter reel, another detector monitors the rotational speed of each lifter reel, and an appropriate means is provided for comparing for each lifter reel the traveling speed of the incoming fabric with the lifter reel rotational speed so that operation of the adjacent associated nozzle can be correspondingly adjusted to eliminate any fabric slippage indicated by a difference in the detected fabric and lifter reel speeds.

Two specific embodiments of the apparatus are presently contemplated. In one embodiment, the first and second travel paths are arranged essentially side-by-side one another, whereas in the other embodiment, one travel path is arranged essentially above the other travel path. In either case, the apparatus is provided with an arrangement for counteracting any tendency of the fabric to spiral during traveling movement along the travel paths. For example, the travel paths may have respective portions which curve in opposite lateral directions from one another to counteract any previously occurring fabric spiraling. Alternatively, first and second fabric delivery tubes may extend respectively from the first and second nozzles into the following travel path, with the delivery tubes being curved in opposition to one another to counteract previously occurring fabric spiraling.

Each fabric travel path preferably is formed by an elongate liquid-collecting pan in conjunction with a plurality of elongate bars extending longitudinally in spaced relation to one another along the pan. The pan communicates with a drain conduit for recirculation of treating liquid collected by the pan to the nozzles. Preferably, the elongate bars are tubular and have perforations for selective flow of treating liquid therethrough to clean lint and debris from the bars.

According to other aspects of the present invention, means may be provided within the vessel for spraying treating liquid on the fabric while traveling along at least one of the travel paths. Means may also be provided for regulating the level of treating liquid contained within the vessel, including means for flooding the vessel when necessary or desirable for cleaning lint and debris therefrom.

DESCRIPTION OF THE PREFERRED EMBODIMENT

Figure 1:
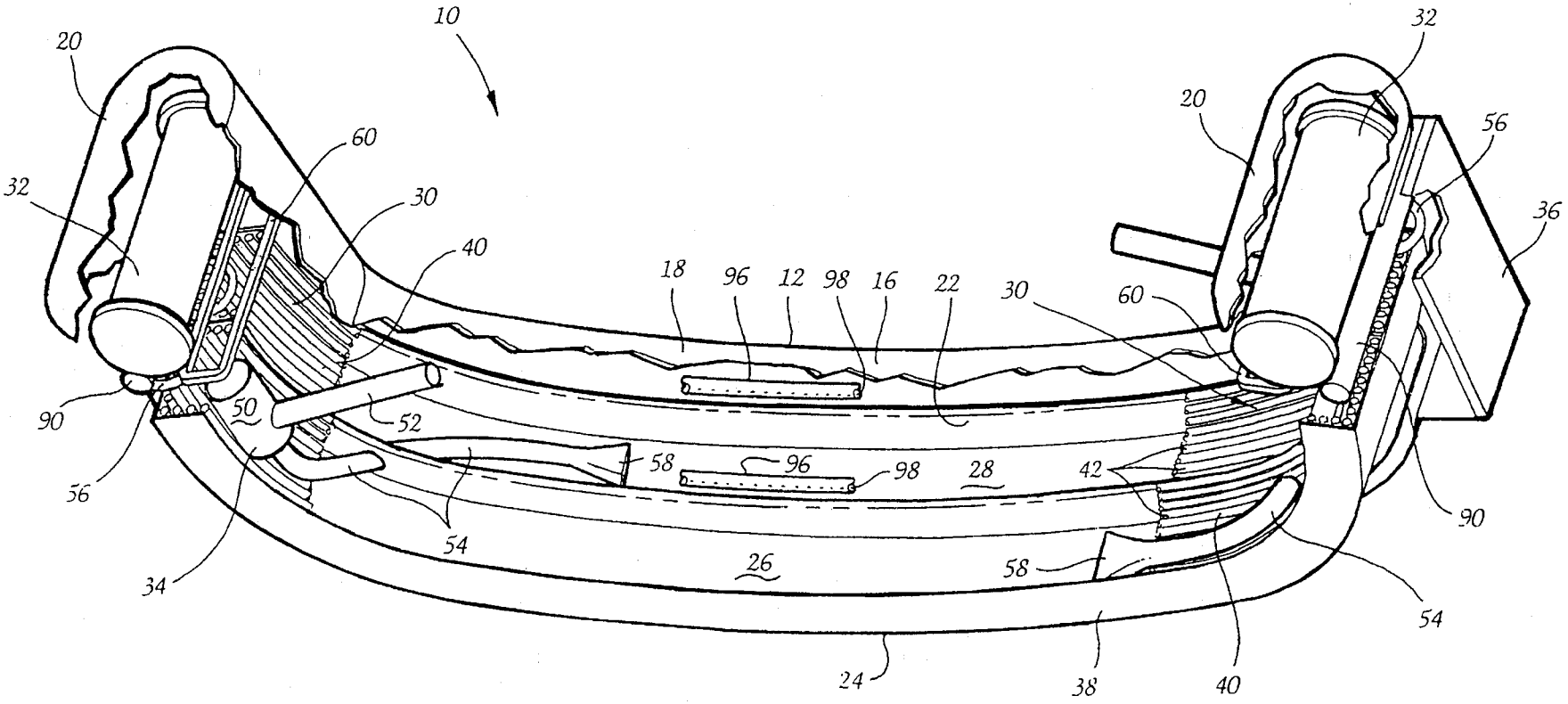
FIG. 1 is a perspective view, partially broken away, of an apparatus for wet processing of textile fabric in accordance with one preferred embodiment of the present invention.

Referring now to the accompanying drawings and initially to FIGS. 1–4, an apparatus for wet processing of textile fabric in an endless rope form in accordance with one preferred embodiment of the present invention is shown generally at 10 and comprises an elongate vessel 12 mounted on supporting legs 14 (FIG. 2) for standing disposition of the apparatus 10 on a floor with the vessel 12 oriented substantially horizontally. The vessel 12 is formed by a substantially hollow housing 16 halving a main elongate fabric treatment section 18 horizontally disposed centrally along the predominate length of the vessel 12 and merging at opposite ends of the treatment section 18 with upwardly inclined end sections 20.

The main fabric treatment section 18 of the vessel housing 16 defines an interior fabric: treatment chamber 22 within which is disposed a channel structure 24 defining opposing side-by-side first and second fabric travel paths 26,28. The end sections 20 of the housing 16 interiorly define fabric transition chambers 30 within each of which are mounted a horizontally-disposed cylindrical lifter reel 32 driven by a drive motor 33 (FIG. 2) and a tubular liquid-applying nozzle assembly 34. Each end section 20 includes an openable and closeable door 36 by which a textile fabric F can be introduced into and removed from the vessel interior.

As more fully described hereinafter, the textile fabric F is processed within the vessel 12 in the form of an endless rope (formed by sewing together opposite ends of an extended length of textile fabric upon introduction into the vessel). The fabric travels in its lengthwise extent continuously through the vessel 12 along a first one of the travel paths 26,28 through the treatment chamber 22 within the main fabric treatment section 18, into the transition chamber 30 within one end section 20 wherein the fabric is drawn upwardly by the lifter reel 32 thereof and then directly downwardly into the associated nozzle assembly 34 which directs and delivers the fabric into the other fabric travel path 26,28, then through that travel path in the opposite direction through the treatment chamber 22 from which the fabric traveled in the previous travel path and into the transition chamber 30 of the other end section 20 wherein its lifter reel 32 draws the fabric upwardly and then downwardly into the associated nozzle assembly 34 to return the fabric into the original travel path. The fabric F circulates in this manner continuously until the particular wet processing operation is completed.

The channel structure 24 comprises an elongate U-shaped liquid collection pan 38 extending the predominate length of the main fabric treatment section 18 of the housing 16 at a slight upward spacing from the bottom wall of the housing 16. Extending longitudinally within the central area defined by the pan 38 at a slight spacing thereabove is an assembly 40 of a plurality of elongate bars or rods 42 connected to one another by brackets 44 in a spaced parallel relation collectively forming a U-shaped channel subdivided lengthwise by a longitudinal dividing wall 46 into two co-extensive sub-channels of equivalent configuration and dimension which form the two fabric travel paths 26,28. The bars 42 are cylindrical in cross-section so as to minimize any risk of damage to the traveling fabric F by frictional contact or engagement with the fabric. The spacing of the bars 42 allows treating liquid carried by the fabric F to freely drain into the collecting pan 38 which communicates with a drain pipe 48 at the lowermost point along the length of the pan 38. The opposite ends of the bars 42 curve upwardly to extend into the transition chambers 30 within the housing end sections 20 in generally close proximity to the respective lifter reels 32.

Each nozzle assembly 34 has a main tubular nozzle body 50 which may be of essentially any conventional nozzle construction, such as a venturi jet configuration adapted to emit an annular flow of treating liquid interiorly of the tubular body 50 in an axial direction for impingement and entrainment of the fabric F as it travels through the tubular body 50. An intake pipe 52 is affixed to the nozzle body 50 for connection with a source of pressurized treating fluid as more fully described hereinafter. A delivery pipe 54 extends axially from the outlet end of the nozzle body 50 for conveyance of the fabric F and the entraining treating liquid into the downstream following travel path 26,28.

Figure 3:
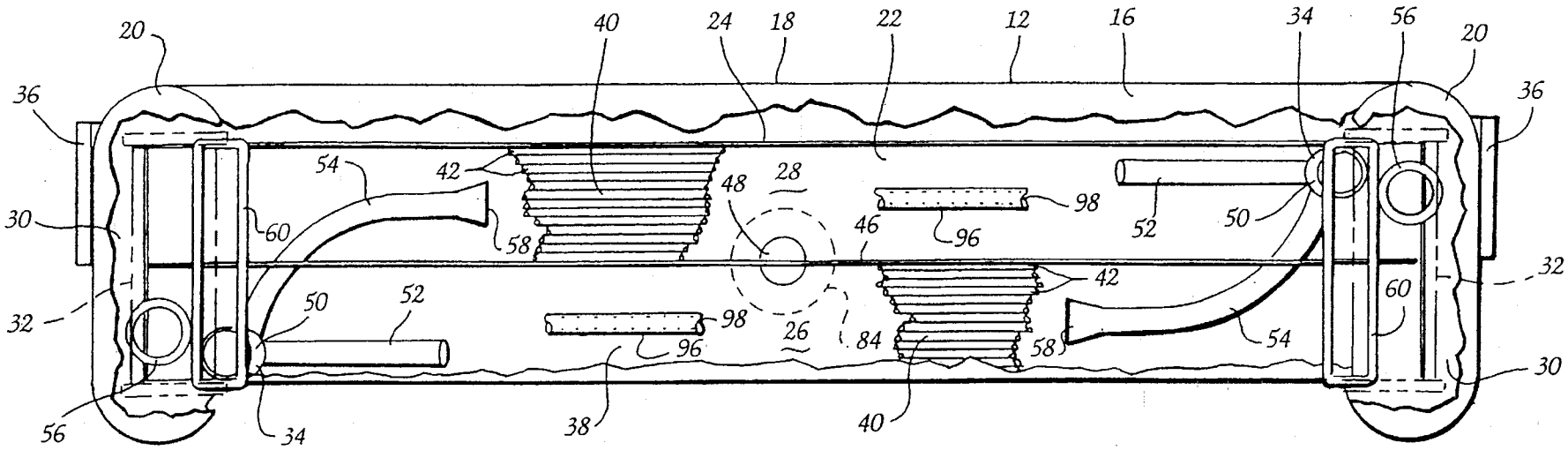
FIG. 3 is a top plan view of the wet processing apparatus of FIG. 1, with the housing broken away.
Figure 4:
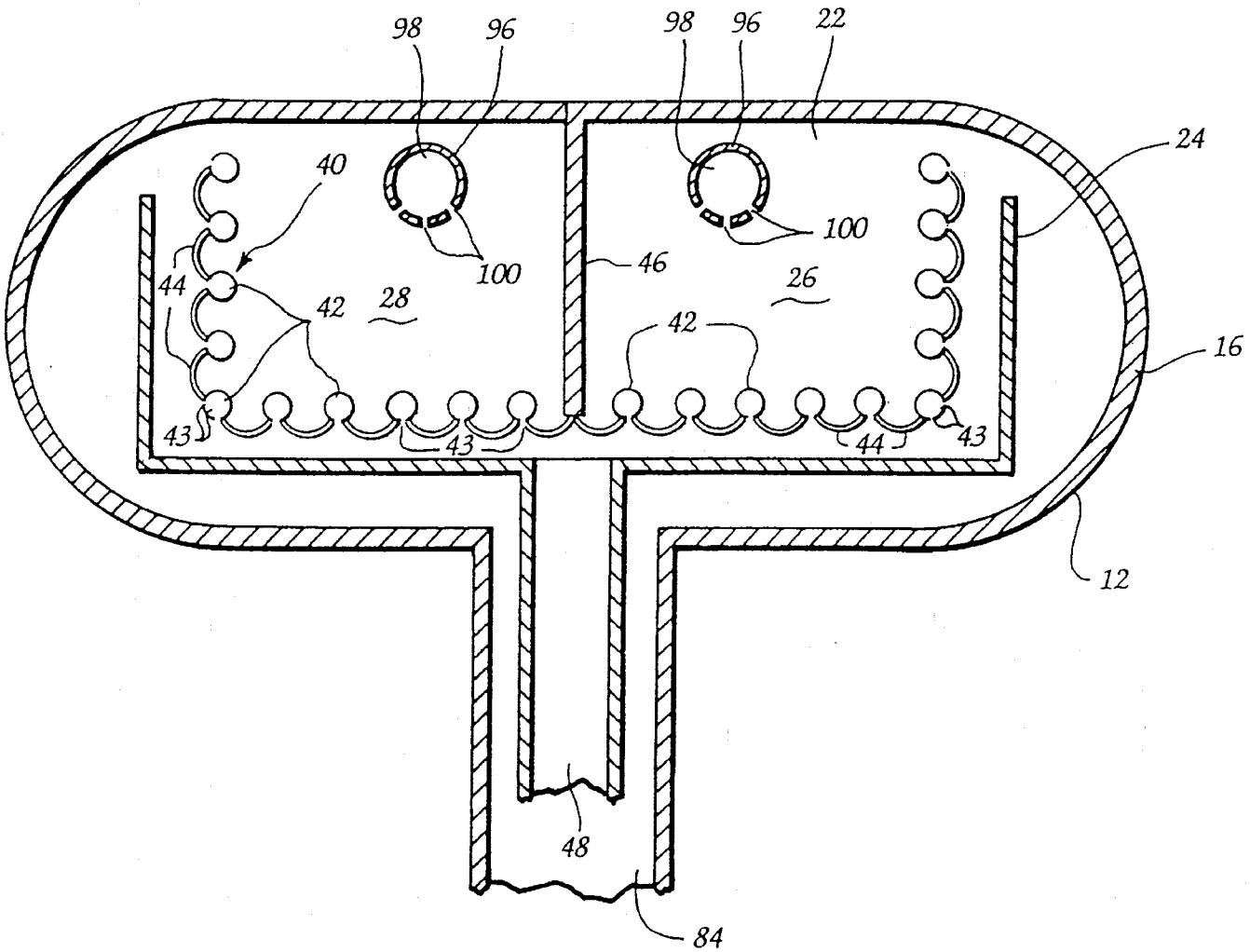
FIG. 4 is a vertical cross-sectional view of the wet processing apparatus of FIG. 1, taken along line 4—4 of FIG. 2.

As best seen in FIG. 3, a fabric guide ring 56 is disposed within each housing end section 20 directly above the end of the travel path 26,28 which exits into that end section 20, the guide ring 56 serving thereby to direct the fabric F upwardly to the periphery of the associated lifter reel 32 as the fabric F exits the incoming travel path 26,28. Each nozzle assembly 34 is disposed within its respective housing end section 20 with the nozzle body 50 generally aligned with the fabric travel path 26,28 which exits into the respective end section 20 to receive the fabric F from the associated lifter reel 32. The delivery pipe 54 of each nozzle assembly 34 is curved three-dimensionally both forwardly and laterally into the treatment chamber 22 of the main fabric treatment section 18 of the vessel housing 16 to transfer the incoming fabric F laterally into the other travel path 26,28 from the travel path just previously exited by the fabric. The exit end of each delivery pipe 54 terminates in an outwardly flared end section 58 to minimize any turbulence in the fabric travel as the fabric F exits each delivery tube 54 into the succeeding travel path 26,28.

Figure 2:
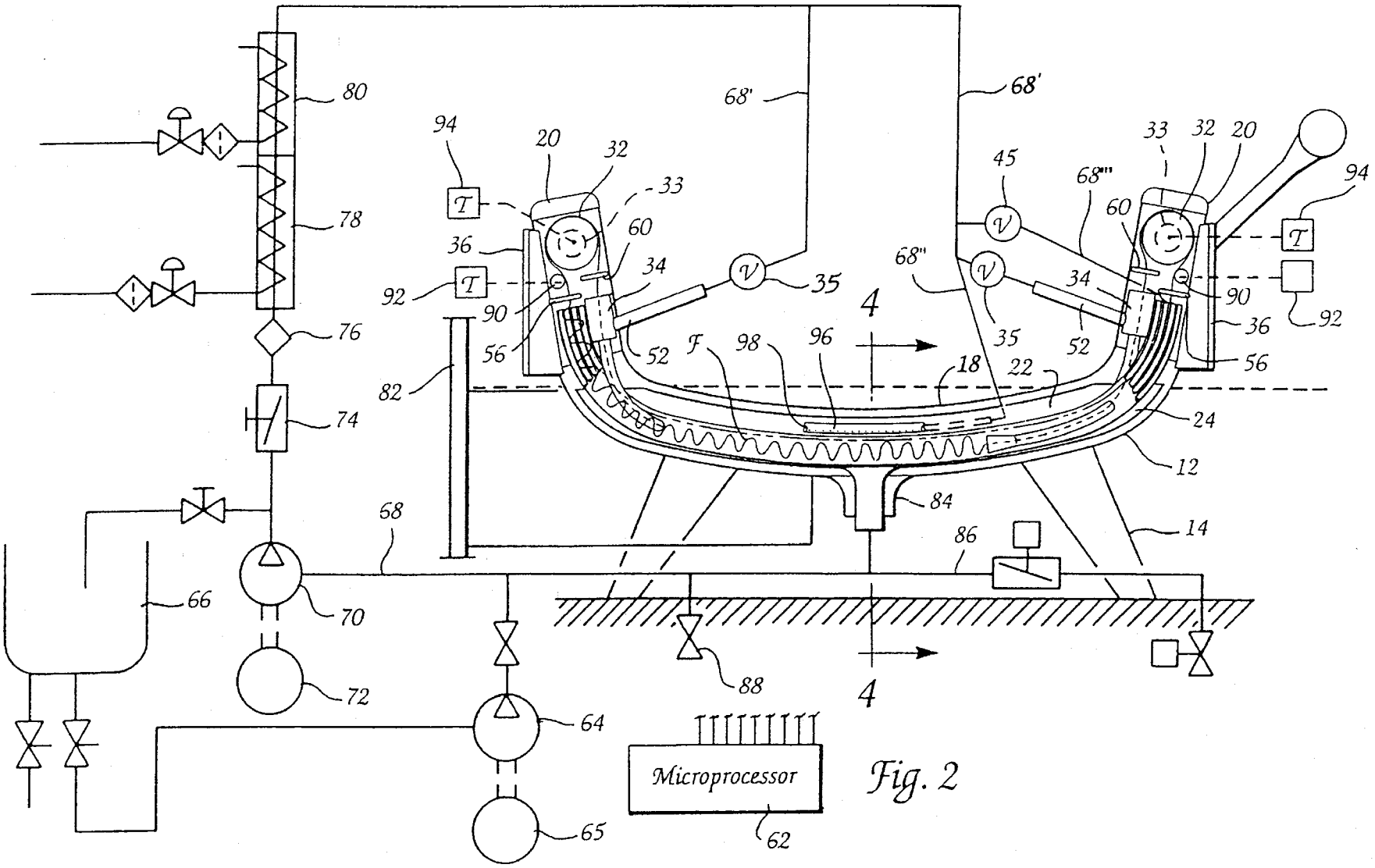
FIG. 2 is a partially schematic side elevational view of the wet processing apparatus of FIG. 1 with the housing broken away.

In FIG. 2, the liquid handling system of the apparatus 10 is shown schematically. A suitable supply quantity of the treating liquid, which may be for example a dye liquor, bleaching solution, water wash, or other appropriate textile processing liquid, is prepared and contained in a storage vessel 66 from which a suitable quantity of the liquid is delivered into the main circulation line 68 of the apparatus 10 by a supply pump 70 operated by an associated pump motor 72. The circulation line 68 is connected to the drain pipe 48 from the pan 38 within the treatment chamber 22 and extends therefrom to a main liquid circulation pump 64 operated by an associated pump motor 65. The circulation line 68 extends from the circulation pump 64 through a throttle valve 74, a liquid filter 76, heating and cooling elements 78,80, and therefrom divides into branch lines 68' connected to the respective intake pipes 52 of the nozzle assemblies 34 through respective intake valves 35. Once a suitable quantity of the treating liquid has been delivered into the main circulation line 68 sufficient to fill the treatment chamber 22 of the vessel 12 to a predetermined liquid level, as monitored by a liquid level meter 82, the supply pump 70 is deactivated and a supply valve 71 at the delivery side of the pump 70 is closed. As the treating liquid is taken up by the fabric F as a wet processing operation progresses, the valve 71 may be opened and the supply pump 70 reactivated if and as necessary to replenish the depleted liquid.

The vessel 12 is also equipped with a disposal drain pipe 84 connected to the bottom wall of the vessel housing 16 concentrically with the recirculating drain pipe 48 (FIGS. 2 and 4), the drain pipe 84 being connected to a liquid disposal line 86 emptying into a waste liquid collection location (not shown). As more fully described hereinafter, the disposal drain pipe 84 functions primarily during flooding operations of the apparatus 10 carried out occasionally for the cleaning purpose of purging fibrous lint, debris, and waste treating liquid from the vessel 12. For this purpose, the main circulation line 68 is connected through a control valve 88 with a source of fresh clean water.

A microprocessor 62 or other suitable programmable controller is connected to the pump motors 65,72, the associated liquid valves, and the drive motors 33 to the lifter reels 32, as well as other operating components of the apparatus 10 for programmed adjustable operating control of the apparatus 10, as more fully described hereinafter.

A detector ring 60, of a conventional type capable of detecting passage therethrough of a fabric seam, is disposed within each housing end section 20 between the lifter reel 32 and the nozzle assembly 34 for travel of the fabric F through each detector ring 60, thereby to recognize each time the fabric seam or seams between the sewn ends of the fabric F pass through the transition chambers 30. The seam detectors 60 are connected to the microprocessor or other controller 62, to signal the microprocessor upon the passage of each fabric seam. In this manner, the microprocessor 62, through appropriate programming, is enabled to calculate and monitor the respective lengths of the fabric portions residing at any given time within the two fabric travel paths 26,28 which, as will be understood, should remain essentially equivalent throughout any wet processing operation. In the event the microprocessor 62 recognizes an unacceptable difference in the lengths of the fabric F within the respective travel paths 26,28 based on the signals received from the seam detectors 60, the microprocessor 62 is programmed to adjustably increase or decrease the driven speed of one of the lifter reels 32 through control of its drive motor 33 and/or to appropriately increase or decrease the liquid flow rate through one of the nozzle assemblies 34 by control of its associated intake valve 35.

It is also desirable to insure that each lifter reel 32 and the associated nozzle assembly 34 are synchronized with one another to prevent slippage of the traveling fabric F on the lifter reels 32. For this purpose, an idler roll 90 is disposed within each housing end section 20 intermediate the respective guide ring 56 and lifter reel 32, to be engaged and rotatably driven by the traveling movement of the fabric F. A tachometer 92 is connected to each idler roll 90 to monitor its rotational speed and, similarly, a tachometer 94 is connected to each lifter reel 32 to monitor its rotational speed, each tachometer 92,94 being connected with the microprocessor 62 which, in turn, is programmed to compare the speed signals received from the associated tachometers 92,94 in order to recognize the occurrence of fabric slippage on either lifter reel 32 as indicated by any significant difference in the peripheral speeds of the associated idler roll 90 and lifter reel 32. In the event fabric slippage is thereby detected, the microprocessor 62 is programmed to appropriately adjust the rate of liquid flow to the associated nozzle assembly 34, e.g., by adjusting the pump motor 65 or the throttle valve 74, or alternatively by adjustment of the intake valve 35 in the branch line 68' to the respective nozzle assembly 34.

As will be understood, the fabric F is subjected to processing by the treating liquid both by liquid impingement during fabric travel through the nozzle assemblies 34 and also by passage through the quantity of treating liquid collected within the pan 38 as the fabric F travels through the opposing travel paths 26,28 defined by the bar assembly 40. For purposes of additional liquid treatment, spray heads 96 extend longitudinally through the main fabric treatment section 18 of the vessel housing 16 above the respective travel paths 26,28 for spraying treating liquid onto the portions of the fabric F traveling therealong. Each spray head 96 basically comprises an elongate tubular pipe 98 formed in the underside thereof with perforations 100 along the length of the pipe. Each spray pipe 98 is connected to a secondary branch line 68" extending from the branch lines 68' to the nozzle assemblies 34 to divert a proportion of the pressurized treating liquid into the spray pipes 98. By the use of the spray heads 96, the portions of the fabric F traveling through the fabric travel paths 26,28 may be kept fully wetted with the treating liquid without maintaining a sufficient quantity of the liquid within the pan 38 to submerge the fabric, thereby enabling the total quantity of treating liquid within the liquid flow system of the apparatus 10 to be minimized.

As previously mentioned, the apparatus 10 of the present invention has the capability of substantially flooding the treatment chamber 22 of the vessel 12 under the control of the liquid level meter 82 by the admission of the fresh clean water (or another suitable flushing liquid) through the valve 88 for purposes of purging the vessel interior of the treating liquid and flushing lint and other debris from the interior. As best understood with reference to FIG. 4, upon flooding of the treatment chamber 22, the liquid level rises to the level of the upper lateral side edges of the liquid collecting pan 38 and then spills over the side walls of the pan into the bottom of the vessel 12 and therefrom through the disposal drain pipe 84. As will be understood, this operation would normally be carried out without any fabric within the vessel 12. Lint and debris is thereby floated and carried by the flooding liquid into the drain 84 to be removed from the vessel 12. To assist in this operation, the bars 42 of the bar assembly 40 within the pan 38 are preferably of a hollow tubular configuration with perforations 43 (FIG. 2) formed along the length of each bar 42 at the side thereof facing away from the fabric travel paths 26,28. The bars are connected through an appropriate manifold (not shown) with a branch line 68''' from one or both of the branch lines 68', the branch lines 68''' being closed by a valve or valves 45 during normal wet processing operations but being opened during flooding operations under the control of the microprocessor 62 to deliver additional flooding liquid through the bars 42.

Figure 5:
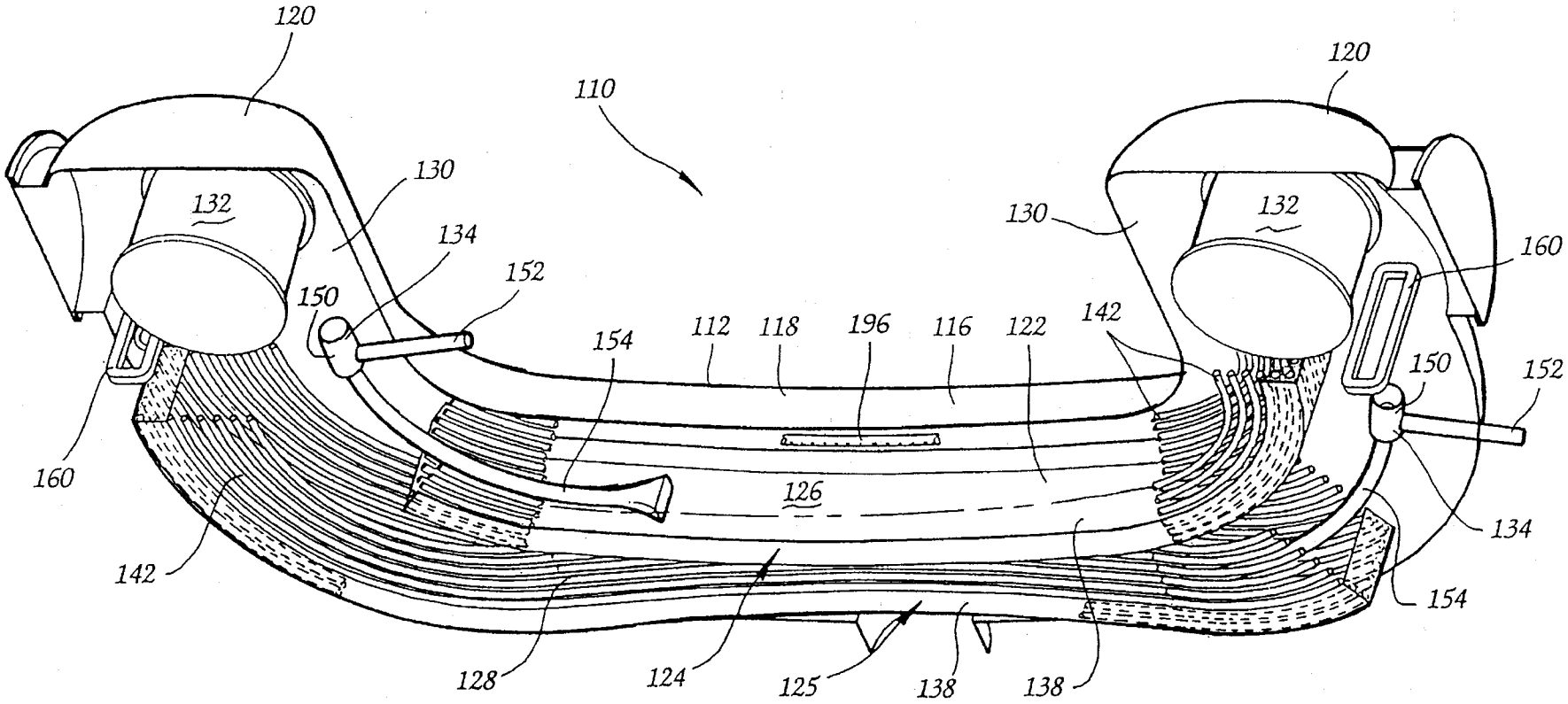
FIG. 5 is a perspective view, partially broken away, of an apparatus for wet processing of textile fabric according to another preferred embodiment of the present invention.
Figure 6:
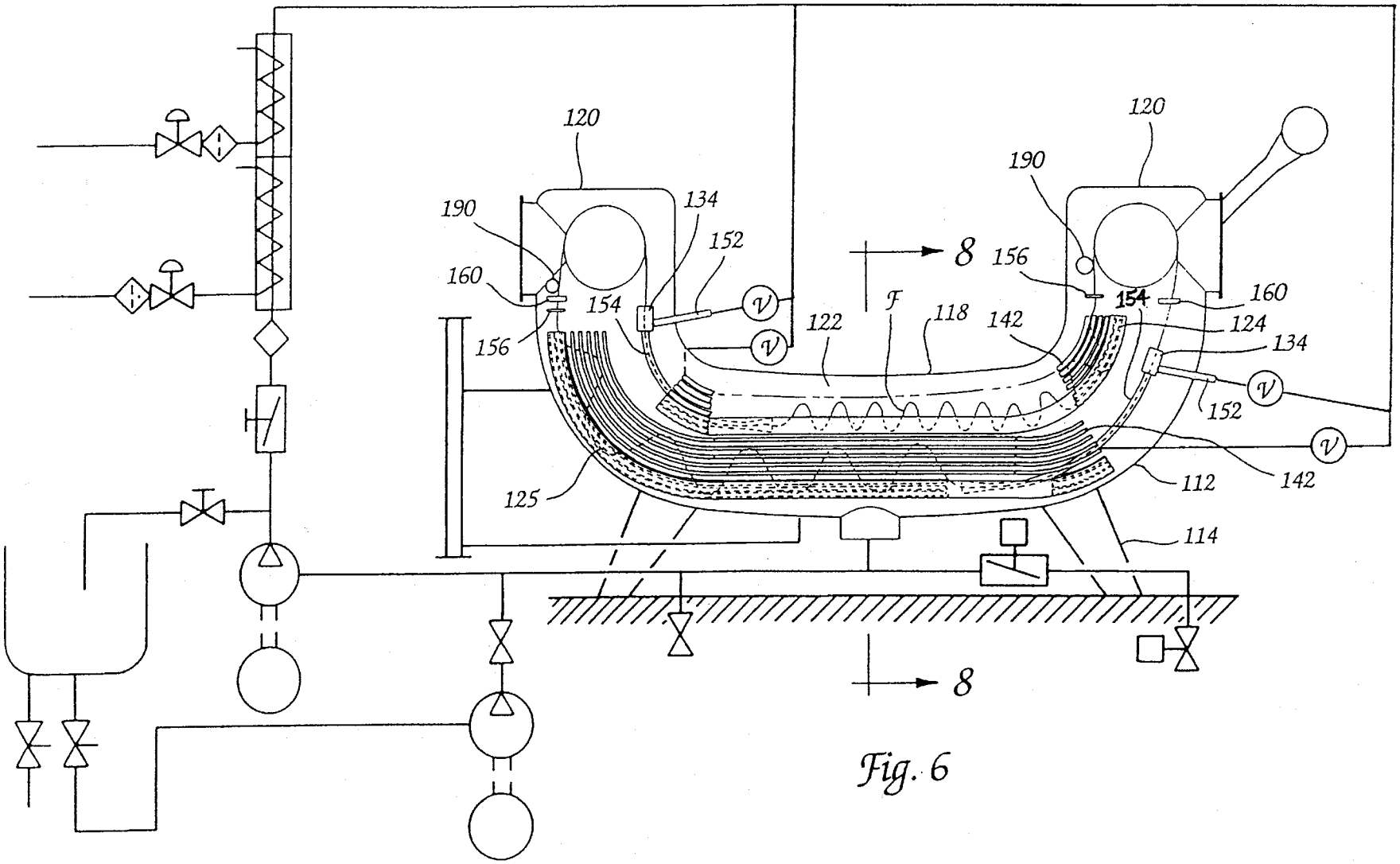
FIG. 6 is a partially schematic side elevational view of the wet processing apparatus of FIG. 5, with the housing broken away.
Figure 7:
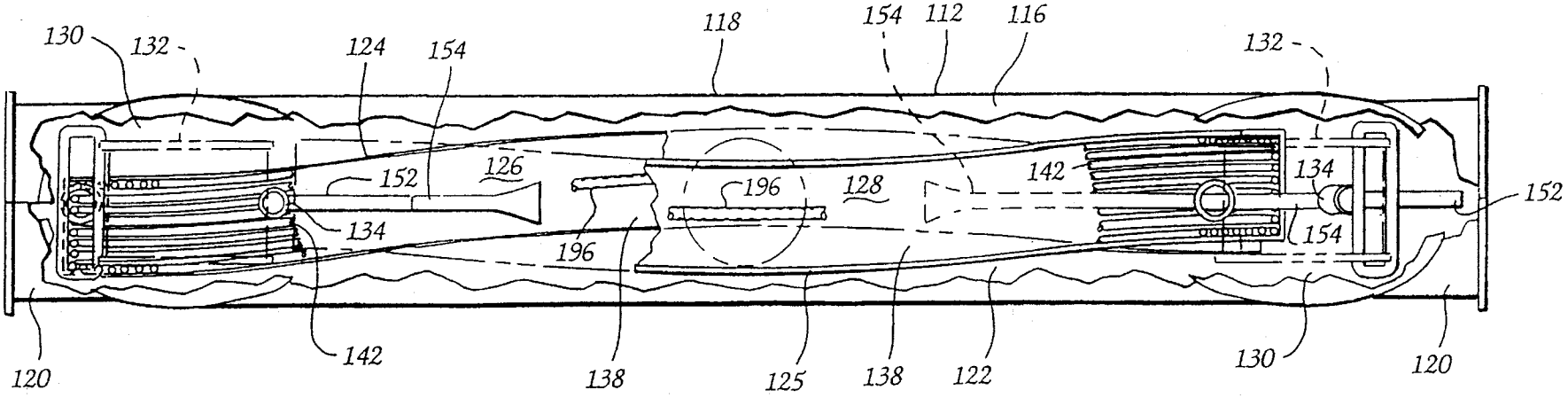
FIG. 7 is a top plan view of the wet processing apparatus of FIG. 5, with the housing broken away.
Figure 8:
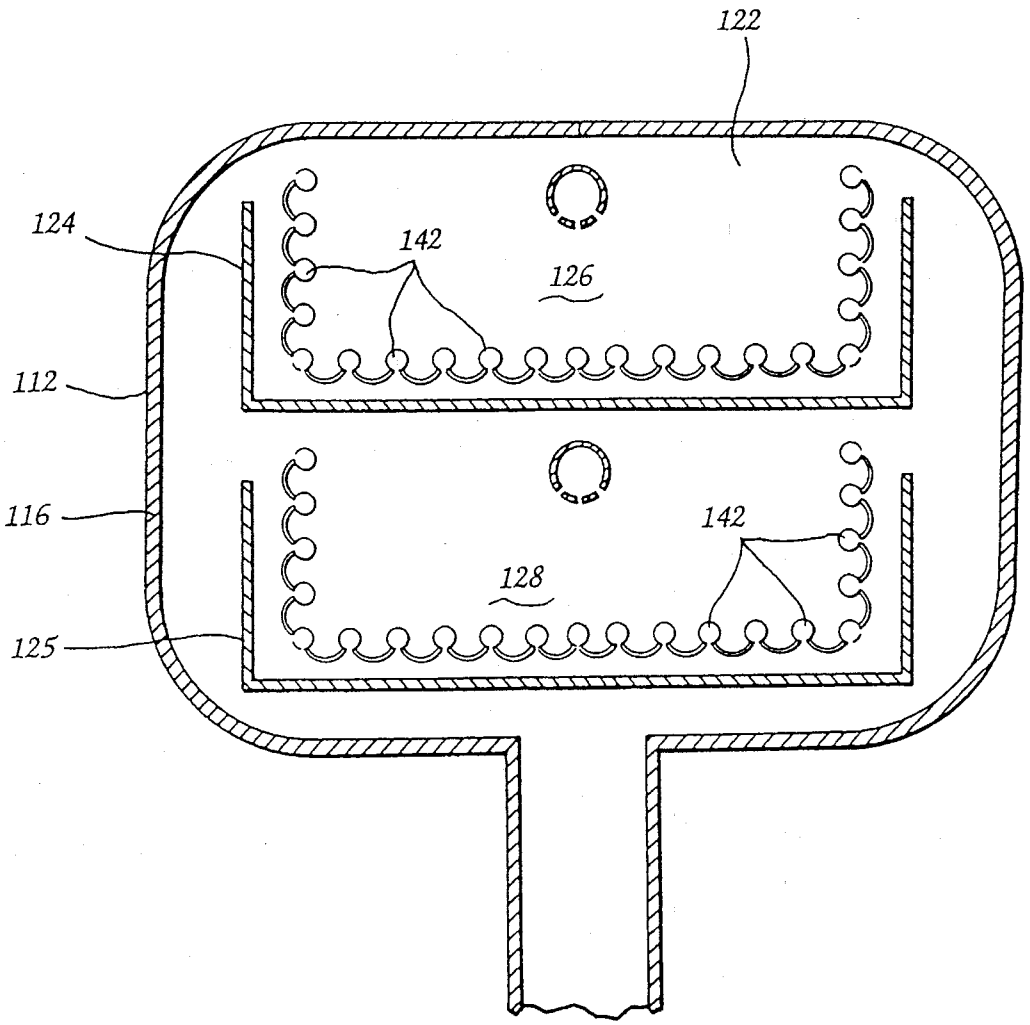
FIG. 8 is a vertical cross-sectional view of the wet processing apparatus of FIG. 5, taken along line 8—8 of FIG. 6.

Referring now to FIGS. 5–7, an alternative embodiment of wet processing apparatus in accordance with the present invention is shown generally at 110. The apparatus 110 is essentially comparable in basic structure and operation to the wet processing apparatus 10 of FIGS. 1–4, but differs fundamentally in that the fabric travel paths 126,128 are arranged with one path 126 directly above the other path 128.

The apparatus 110 has a fabric treatment vessel 112 formed of an elongated housing 116 supported on legs 114. The housing 116 is substantially hollow with an elongate main fabric treatment section 118 defining an interior treatment chamber 122 and extending horizontally between upwardly inclined housing end sections 120 which define interior fabric transition chambers 130.

Within the main treatment section 118 of the housing 116, upper and lower channel structures 124,125, respectively, define the upper and lower fabric travel paths 126,128. Each channel structure basically comprises a U-shaped substantially imperforate pan 138 with a co-extensive U-shaped assembly of elongate spaced parallel bars 142 disposed within the pan 138 and extending upwardly from each opposite lateral side thereof to collectively define the respective fabric travel path.

Each housing end section 120 contains a motor-driven lifter reel 132 disposed directly above the end of the fabric travel path 126 or 128 which exits into the end section 120, a guide ring 156 and a tachometer-monitored idler roller 190 disposed between the exit end of the travel path and the lifter reel, and a fabric seam detector ring 160. A nozzle assembly 134 extends from adjacent the fabric delivery side of each lifter reel 132 downwardly into the succeeding travel path 126,128, each nozzle assembly 134 having a main tubular nozzle body 150 to which a liquid intake pipe 152 and a fabric/liquid delivery pipe 154 are connected. As shown in FIG. 6, the liquid flow control system for the apparatus 110 is substantially identical to that described above for the apparatus 10 of FIGS. 1–4.

In basic operation, an endless rope of textile fabric F travels first through the fabric travel path of one channel structure 124,125 into one housing end section 120; therefrom, upwardly through the guide ring 156, over the idler roller 190, and into the nozzle assembly 134 within that housing end section 120; through the fabric travel path of the other channel structure 124,125 in the opposite direction to the fabric's previous travel through the first travel path; and then through and over the guide ring 156, the idler roller 190, the lifter reel 132, and the nozzle assembly 134 of the other end section to return the fabric to the original travel path to repeat the described traveling movement. The treating liquid which impinges and entrains the fabric F as it travels through each nozzle assembly 134 collects in the pan 138 of the succeeding channel structure 124,125 so that the fabric F is subjected to liquid treatment substantially during the entirety of the fabric's circulation within the vessel 112, even though the total quantity of liquid contained within the vessel is relatively low. Spray heads 196 may also be provided above each travel path 126,128 in similar manner to that illustrated and described above with respect to the embodiment of FIGS. 1–4. To counteract any tendency of the fabric F to spiral as it travels through the vessel 112, the pans 138 of the respective channel structures 124,125 are oppositely curved laterally outwardly and inwardly along their respective longitudinal extents, as best seen in FIG. 7.

The apparatus of each embodiment of the present invention accordingly provides a number of distinct advantages over conventional jet-type machines for wet processing textile fabrics in endless rope form. By the provision of two fabric entraining liquid nozzle assemblies in conjunction with two opposing fabric travel paths, the present apparatus is enabled to maintain a textile fabric in substantially continuous movement along predominantly its entire length without the necessity of containing a bath of a sufficient quantity of the treatment liquid within the vessel to float the fabric from one side or end of the vessel to the other, whereby the total quantity of treating liquid necessary to accomplish a given processing operation can be minimized when appropriate. The dual nozzles, dual lifter reels, and dual fabric travel paths additionally enable the overall fabric speed to be more widely controlled than with conventional machines and, together with the increased ability to regulate the total quantity of treating liquid, provides the present apparatus with a widely variable fabric treatment capacity. Accordingly, the present apparatus provides the flexibility of processing a given length of fabric in approximately one-half the time which would normally be required in a conventional machine, or of processing up to twice the amount of fabric which could be processed in a conventional machine in a given wet processing cycle time. The flexibility of operating the apparatus at variable liquid levels within the treatment chamber of the vessel, particularly in the embodiment of FIGS. 1–4, enables the machine to be used for processing a wide variety of differing fabrics, including fabrics which are highly sensitive to handling operations, such as all-cotton fabrics, spandex fabrics, etc. The capability of the machine for flushing operations by flooding the vessel interior while still operating the flow nozzles and with the assistance of liquid flow through the bar assembly of the travel paths allows efficient cleaning and draining of the vessel with minimal water usage. The ability of the curved fabric delivery pipes in the embodiment of FIGS. 1–4 and the oppositely curved fabric pans in the embodiment of FIGS. 5–7 to counteract any tendency of the fabric to spiral during ongoing processing minimizes the risk of sub-quality results in dyeing and other wet processing operations. Finally, the provision of dual jets and lifter reels improves the efficiency of fabric loading and unloading into and from the vessel in each embodiment of the invention.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for wet processing of textile fabric in endless rope form comprising an elongated processing vessel generally horizontally disposed in its lengthwise extent for containing the fabric and a treating liquid, means fixedly disposed within the vessel for defining first and second fabric travel paths each having an entrance and an exit end, the travel paths extending predominantly horizontally along substantially the lengthwise extent of the vessel in opposition to one another with the entrance and exit ends of each path generally adjacent the exit and entrance ends, respectively, of the other path for continuous lengthwise movement of the fabric relative to the defining means in successive alternation through the first and second travel paths, and means disposed intermediate the adjacent entrance and exit ends of the travel paths for transferring the fabric between, and continuously circulating the fabric through, the first and second travel paths, the transferring and circulating means including first and second liquid nozzle means at the respective entrance ends of the first and second travel paths for entrainment of the fabric by a moving portion of the treating liquid, and the transferring and circulating means further including first and second lifter reels at the respective exit ends of the first and second travel paths for progressively withdrawing the fabric therefrom and delivering the withdrawn fabric at each location to the respective nozzle means at the adjacent entrance end of the other travel path.

2. Apparatus for wet processing of textile fabric according to claim 1 wherein the transferring and circulating means includes means for substantially synchronizing traveling movement of the fabric through the first and second travel paths.

3. Apparatus for wet processing of textile fabric according to claim 2 wherein the synchronizing means comprises means for determining the instantaneous length of the fabric residing within each travel path at a selected time during a wet processing operation.

4. Apparatus for wet processing of textile fabric according to claim 3 wherein the fabric length determining means comprises first and second means for detecting fabric seams respectively disposed intermediate the adjacent entrance and exit ends of the travel paths.

5. Apparatus for wet processing of textile fabric according to claim 1 wherein the transferring and circulating means includes means for detecting slippage of the fabric on the lifter reels and means for correspondingly adjusting operation of the adjacent associated nozzle means to eliminate the fabric slippage.

6. Apparatus for wet processing of textile fabric according to claim 5 wherein the slippage detection means comprises means for detecting the traveling speed of the fabric in advance of each lifter reel, means for detecting the rotational speed of each lifter reel, and means for comparing the advance fabric traveling speed with the lifter reel rotational speed.

7. Apparatus for wet processing of textile fabric according to claim 1 and further comprising means for counteracting spiraling of the fabric during traveling movement along the travel paths.

8. Apparatus for wet processing of textile fabric according to claim 7 wherein each travel path has a portion which is curved laterally of the direction of lengthwise fabric movement, the respective curved portions of the travel paths being curved in opposite lateral directions from one another to counteract any previously occurring fabric spiraling.

9. Apparatus for wet processing of textile fabric according to claim 7 wherein the spiraling counteracting means comprises first and second fabric delivery tubes for directing the fabric from each nozzle means into the following travel path, the delivery tubes being curved in opposition to one another to counteract any previously occurring fabric spiraling.

10. Apparatus for wet processing of textile fabric according to claim 1 wherein each fabric travel path comprises an elongate liquid-collecting pan and a plurality of elongate bars extending longitudinally in spaced relation to one another along the pan to define the fabric travel path.

11. Apparatus for wet processing of textile fabric according to claim 10 wherein the pan communicates with a drain conduit for recirculation of treating liquid collected by the pan to the nozzle means.

12. Apparatus for wet processing of textile fabric according to claim 10 wherein the elongate bars are tubular and have perforations therein for selective flow of treating liquid therethrough for cleaning lint and debris therefrom.

13. Apparatus for wet processing of textile fabric according to claim 1 wherein the travel paths are arranged essentially side by side one another.

14. Apparatus for wet processing of textile fabric according to claim 1 wherein one travel path is arranged essentially above the other travel path.

15. Apparatus for wet processing of textile fabric according to claim 1 and means for spraying treating liquid on the fabric within at least one travel path.

16. Apparatus for wet processing of textile fabric according to claim 1 and further comprising means for regulating the level of treating liquid contained within the vessel.

17. Apparatus for wet processing of textile fabric according to claim 1 and means for flooding the vessel for cleaning lint and debris therefrom.

18. Apparatus for wet processing of textile fabric in endless rope form comprising a processing vessel for containing the fabric and a treating liquid, means within the vessel for defining first and second fabric travel paths each having an entrance and an exit end, the travel paths extending in opposition to one another with the entrance and exit ends of each path generally adjacent the exit and entrance ends, respectively, of the other path for lengthwise movement of the fabric in successive alternation through the first and second travel paths, and means disposed intermediate the adjacent entrance and exit ends of the travel paths for transferring the fabric between, and continuously circulating the fabric through, the first and second travel paths, the transferring and circulating means including first and second liquid nozzle means at the respective entrance ends of the first and second travel paths for entrainment of the fabric by a moving portion of the treating liquid, first and second lifter reels at the respective exit ends of the first and second travel paths for progressively withdrawing the fabric therefrom and delivering the withdrawn fabric at each location to the respective nozzle means at the adjacent entrance end of the other travel path, and means for detecting slippage of the fabric on the lifter reels and means for correspondingly adjusting operation of the adjacent associated nozzle means to eliminate the fabric slippage.

19. Apparatus for wet processing of textile fabric according to claim 18 wherein the slippage detection means comprises means for detecting the traveling speed of the fabric in advance of each lifter reel, means for detecting the rotational speed of each lifter reel, and means for comparing the advance fabric traveling speed with the lifter reel rotational speed.

20. Apparatus for wet processing of textile fabric in endless rope form comprising a processing vessel for containing the fabric and a treating liquid, means within the vessel for defining first and second fabric travel paths each having an entrance and an exit end, the travel paths extending in opposition to one another with the entrance and exit ends of each path generally adjacent the exit and entrance ends, respectively, of the other path for lengthwise movement of the fabric in successive alternation through the first and second travel paths, and means disposed intermediate the adjacent entrance and exit ends of the travel paths for transferring the fabric between, and continuously circulating the fabric through, the first and second travel paths, the transferring and circulating means including first and second liquid nozzle means at the respective entrance ends of the first and second travel paths for entrainment of the fabric by a moving portion of the treating liquid, the means for defining the travel paths having means for counteracting spiraling of the fabric during traveling movement along the travel paths comprising a portion of each travel path which is curved laterally of the direction of lengthwise fabric movement, the respective curved portions of the travel paths being curved in opposite lateral directions from one another to counteract any previously occurring fabric spiraling.

21. Apparatus for wet processing of textile fabric in endless rope form comprising a processing vessel for containing the fabric and a treating liquid, means within the vessel for defining first and second fabric travel paths each having an entrance and an exit end, the travel paths extending in opposition to one another with the entrance and exit ends of each path generally adjacent the exit and entrance ends, respectively, of the other path for lengthwise movement of the fabric in successive alternation through the first and second travel paths, and means disposed intermediate the adjacent entrance and exit ends of the travel paths for transferring the fabric between, and continuously circulating the fabric through, the first and second travel paths, the transferring and circulating means including first and second liquid nozzle means at the respective entrance ends of the first and second travel paths for entrainment of the fabric by a moving portion of the treating liquid, wherein each fabric travel path comprises an elongate liquid-collecting pan and a plurality of elongate bars extending longitudinally in spaced relation to one another along the pan to define the fabric travel path, and the elongate bars being tubular and having perforations therein for selective flow of treating liquid therethrough for cleaning lint and debris therefrom.

* * * * *